US009719171B2

(12) United States Patent
Wainwright et al.

(10) Patent No.: US 9,719,171 B2
(45) Date of Patent: Aug. 1, 2017

(54) ROLL-TO-ROLL ELECTROLESS PLATING SYSTEM WITH SPREADER DUCT

(71) Applicants: Gary P. Wainwright, Fairport, NY (US); Shawn A. Reuter, Rochester, NY (US)

(72) Inventors: Gary P. Wainwright, Fairport, NY (US); Shawn A. Reuter, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 343 days.

(21) Appl. No.: 14/484,866

(22) Filed: Sep. 12, 2014

(65) Prior Publication Data

US 2016/0076150 A1 Mar. 17, 2016

(51) Int. Cl.

| | |
|---|---|
| ***C23C 18/16*** | (2006.01) |
| ***C23C 18/38*** | (2006.01) |
| *C23C 18/32* | (2006.01) |
| *C23C 18/42* | (2006.01) |

(52) U.S. Cl.

CPC ..... *C23C 18/1628* (2013.01); *C23C 18/1619* (2013.01); *C23C 18/1669* (2013.01); *C23C 18/1675* (2013.01); *C23C 18/1683* (2013.01); *C23C 18/38* (2013.01); *C23C 18/32* (2013.01); *C23C 18/42* (2013.01)

(58) Field of Classification Search

None

See application file for complete search history.

(56) References Cited

U.S. PATENT DOCUMENTS

| | | | | |
|---|---|---|---|---|
| 4,491,506 | A | 1/1985 | Sakai et al. | |
| 4,514,266 | A * | 4/1985 | Cole | C25D 7/0614 204/206 |
| 4,616,596 | A | 10/1986 | Helber, Jr. et al. | |
| 4,684,545 | A | 8/1987 | Fey et al. | |
| 5,100,518 | A | 3/1992 | Fuchs et al. | |
| 5,284,520 | A | 2/1994 | Tanaka | |
| 2008/0230393 | A1 * | 9/2008 | Okazaki | C23C 18/1608 205/123 |
| 2011/0007011 | A1 | 1/2011 | Mozdzyn | |

(Continued)

FOREIGN PATENT DOCUMENTS

| | | |
|---|---|---|
| JP | 03-146675 A | 6/1991 |
| JP | H08-283954 | 10/1996 |

(Continued)

*Primary Examiner* — Charles Capozzi

(74) *Attorney, Agent, or Firm* — Kevin E. Spaulding

(57) ABSTRACT

A roll-to-roll electroless plating system including a sump and a pan containing a plating solution. A web advance system advances a web of substrate though the plating solution in the pan along a web advance direction, wherein a plating substance in the plating solution is plated onto predetermined locations on a surface of the web of substrate. A pan-replenishing pump moves plating solution from the sump to an inlet of the pan through a pipe connected to an outlet of the pan-replenishing pump, the inlet of the pan being located below the web of substrate. A spreader duct includes a channel that is in fluidic communication with the inlet of the pan, wherein the channel is positioned below the web of substrate and includes at least one outlet disposed beyond the first edge or the second edge of the web of substrate.

13 Claims, 12 Drawing Sheets

(56) References Cited

U.S. PATENT DOCUMENTS

| | | | | |
|---|---|---|---|---|
| 2011/0214608 | A1 | 9/2011 | Ivanov et al. | |
| 2012/0298515 | A1* | 11/2012 | Skupin | C25D 21/12<br>205/99 |

FOREIGN PATENT DOCUMENTS

| | | |
|---|---|---|
| JP | 2011-225923 | 11/2011 |
| WO | 2013/063188 | 5/2013 |

* cited by examiner

ROLL-TO-ROLL ELECTROLESS PLATING SYSTEM WITH SPREADER DUCT

CROSS-REFERENCE TO RELATED APPLICATIONS

Reference is made to commonly-assigned, co-pending U.S. patent application Ser. No. 14/455,196, entitled "Roll-to-roll electroless plating system with low dissolved oxygen content" by G. Wainwright et al.; to commonly-assigned, co-pending U.S. patent application Ser. No. 14/455,227, entitled "Method for roll-to-roll electroless plating with low dissolved oxygen content" by G. Wainwright et al.; and to commonly-assigned, co-pending U.S. patent application Ser. No. 14/455,246, entitled "Roll-to-roll electroless plating system with micro-bubble injector" by G. Wainwright et al., each of which is incorporated herein by reference.

FIELD OF THE INVENTION

This invention pertains to the field of roll-to-roll electroless plating, and more particularly to a system for replenishing the plating solution while inhibiting the trapping of gas bubbles beneath the web.

BACKGROUND OF THE INVENTION

Electroless plating, also known as chemical or autocatalytic plating, is a non-galvanic plating process that involves chemical reactions in an aqueous plating solution that occur without the use of external electrical power. Typically, the plating occurs as hydrogen is released by a reducing agent and oxidized, thus producing a negative charge on the surface of the part to be plated. The negative charge attracts metal ions out of the plating solution to adhere as a metalized layer on the surface. Using electroless plating to provide metallization in predetermined locations can be facilitated by first depositing a catalytic material in the predetermined locations. This can be done, for example by printing features using an ink containing a catalytic component.

Touch screens are visual displays with areas that may be configured to detect both the presence and location of a touch by, for example, a finger, a hand or a stylus. Touch screens may be found in televisions, computers, computer peripherals, mobile computing devices, automobiles, appliances and game consoles, as well as in other industrial, commercial and household applications. A capacitive touch screen includes a substantially transparent substrate which is provided with electrically conductive patterns that do not excessively impair the transparency—either because the conductors are made of a material, such as indium tin oxide, that is substantially transparent, or because the conductors are sufficiently narrow that the transparency is provided by the comparatively large open areas not containing conductors. For capacitive touch screens having metallic conductors, it is advantageous for the features to be highly conductive but also very narrow. Capacitive touch screen sensor films are an example of an article having very fine features with improved electrical conductivity resulting from an electroless plated metal layer.

Projected capacitive touch technology is a variant of capacitive touch technology. Projected capacitive touch screens are made up of a matrix of rows and columns of conductive material that form a grid. Voltage applied to this grid creates a uniform electrostatic field, which can be measured. When a conductive object, such as a finger, comes into contact, it distorts the local electrostatic field at that point. This is measurable as a change in capacitance. The capacitance can be measured at every intersection point on the grid. In this way, the system is able to accurately track touches. Projected capacitive touch screens can use either mutual capacitive sensors or self capacitive sensors. In mutual capacitive sensors, there is a capacitor at every intersection of each row and each column. A 16×14 array, for example, would have 224 independent capacitors. A voltage is applied to the rows or columns. Bringing a finger or conductive stylus close to the surface of the sensor changes the local electrostatic field which reduces the mutual capacitance. The capacitance change at every individual point on the grid can be measured to accurately determine the touch location by measuring the voltage in the other axis. Mutual capacitance allows multi-touch operation where multiple fingers, palms or styli can be accurately tracked at the same time.

WO 2013/063188 by Petcavich et al. discloses a method of manufacturing a capacitive touch sensor using a roll-to-roll process to print a conductor pattern on a flexible transparent dielectric substrate. A first conductor pattern is printed on a first side of the dielectric substrate using a first flexographic printing plate and is then cured. A second conductor pattern is printed on a second side of the dielectric substrate using a second flexographic printing plate and is then cured. The ink used to print the patterns includes a catalyst that acts as seed layer during subsequent electroless plating. The electrolessly plated material (e.g., copper) provides the low resistivity in the narrow lines of the grid needed for excellent performance of the capacitive touch sensor. Petcavich et al. indicate that the line width of the flexographically printed material can be 1 to 50 microns.

Flexography is a method of printing or pattern formation that is commonly used for high-volume printing runs. It is typically employed in a roll-to-roll format for printing on a variety of soft or easily deformed materials including, but not limited to, paper, paperboard stock, corrugated board, polymeric films, fabrics, metal foils, glass, glass-coated materials, flexible glass materials and laminates of multiple materials. Coarse surfaces and stretchable polymeric films are also economically printed using flexography.

Flexographic printing members are sometimes known as relief printing members, relief-containing printing plates, printing sleeves, or printing cylinders, and are provided with raised relief images onto which ink is applied for application to a printable material. While the raised relief images are inked, the recessed relief "floor" should remain free of ink.

Although flexographic printing has conventionally been used in the past for printing of images, more recent uses of flexographic printing have included functional printing of devices, such as touch screen sensor films, antennas, and other devices to be used in electronics or other industries. Such devices typically include electrically conductive patterns.

To improve the optical quality and reliability of the touch screen, it has been found to be preferable that the width of the grid lines be approximately 2 to 10 microns, and even more preferably to be 4 to 8 microns. In addition, in order to be compatible with the high-volume roll-to-roll manufacturing process, it is preferable for the roll of flexographically printed material to be electroless plated in a roll-to-roll electroless plating system. More conventionally, electroless plating is performed by immersing the item to be plated in a tank of plating solution. However, for high volume uniform plating of features on both sides of the web of substrate material, it is preferable to perform the electroless plating in a roll-to-roll electroless plating system.

Dissolved oxygen content of an electroless plating solution influences the rate and quality of the plating. As indicated in U.S. Pat. No. 4,616,596 to Helber Jr. et al., entitled "Electroless plating apparatus," U.S. Pat. No. 4,684,545 to Fey et al., entitled "Electroless plating with bi-level control of dissolved oxygen," and U.S. Patent Application Publication No. 2011/0214608 to Ivanov et al., entitled "Electroless Plating System," increased oxygen content tends to stabilize plating and decrease the plating rate. Decreased oxygen content tends to increase plating activity. Air can be added to the plating solution to increase the dissolved oxygen content. Alternatively, an inert gas such as nitrogen can be added to the plating solution to decrease the dissolved oxygen content. As disclosed in U.S. Pat. No. 5,284,520 to Tanaka, entitled "Electroless Plating Device," for an immersion plating tank where air is blown into the plating solution, a shield plate having small perforations can be used to allow distribution of the oxygenated plating solution without allowing air bubbles to directly contact the object to be plated.

Roll-to-roll electroless plating systems are commercially available from Chemcut Corporation, for example. In such systems, a web of media is advanced substantially horizontally through a pan of plating solution. The plating solution in the pan is replenished from a sump. It has been found that in a roll-to-roll electroless plating system if the replenishment inlet to the pan is directly below the horizontal web of media, and if air or gas bubbles are injected into the plating solution shortly before entering the replenishment inlet to the pan, some of the bubbles can become trapped beneath the web of media, thereby interfering with uniform plating on the lower side of the web of media. What is needed is a system that allows the addition of air or gas into the plating solution being replenished into the pan and facilitates mixing of the replenished plating solution within the pan in such a way that bubbles are not trapped beneath the web of media.

SUMMARY OF THE INVENTION

The present invention represents a roll-to-roll electroless plating system, comprising:

a sump containing a first volume of a plating solution;

a pan containing a second volume of the plating solution, the second volume being less than the first volume;

a web advance system for advancing a web of substrate from an input roll though the plating solution in the pan along a web advance direction and to a take-up-roll, the web of substrate including a first edge and a second edge that is separated from the first edge along a cross-track direction perpendicular to the web advance direction, wherein a plating substance in the plating solution is plated onto predetermined locations on a surface of the web of substrate as it is advanced through the plating solution in the pan;

a pan-replenishing pump for moving plating solution from the sump to an inlet of the pan through a pipe connected to an outlet of the pan-replenishing pump, the inlet of the pan being located in proximity to a bottom of the pan below the web of substrate; and a spreader duct including a channel that is in fluidic communication with the inlet of the pan, wherein the channel is positioned below the web of substrate and includes at least one outlet disposed beyond the first edge or the second edge of the web of substrate.

This invention has the advantage that any bubbles of gas that are introduced in the plating solution upstream of the inlet of the pan are directed beyond the edges of the web of substrate so that they do not collect on a bottom surface of the substrate where they would impact the uniformity of the plating process.

It has the additional advantage that a plurality of outlets can be provided to control the distribution of the plating solution within the pan.

Figure 1:
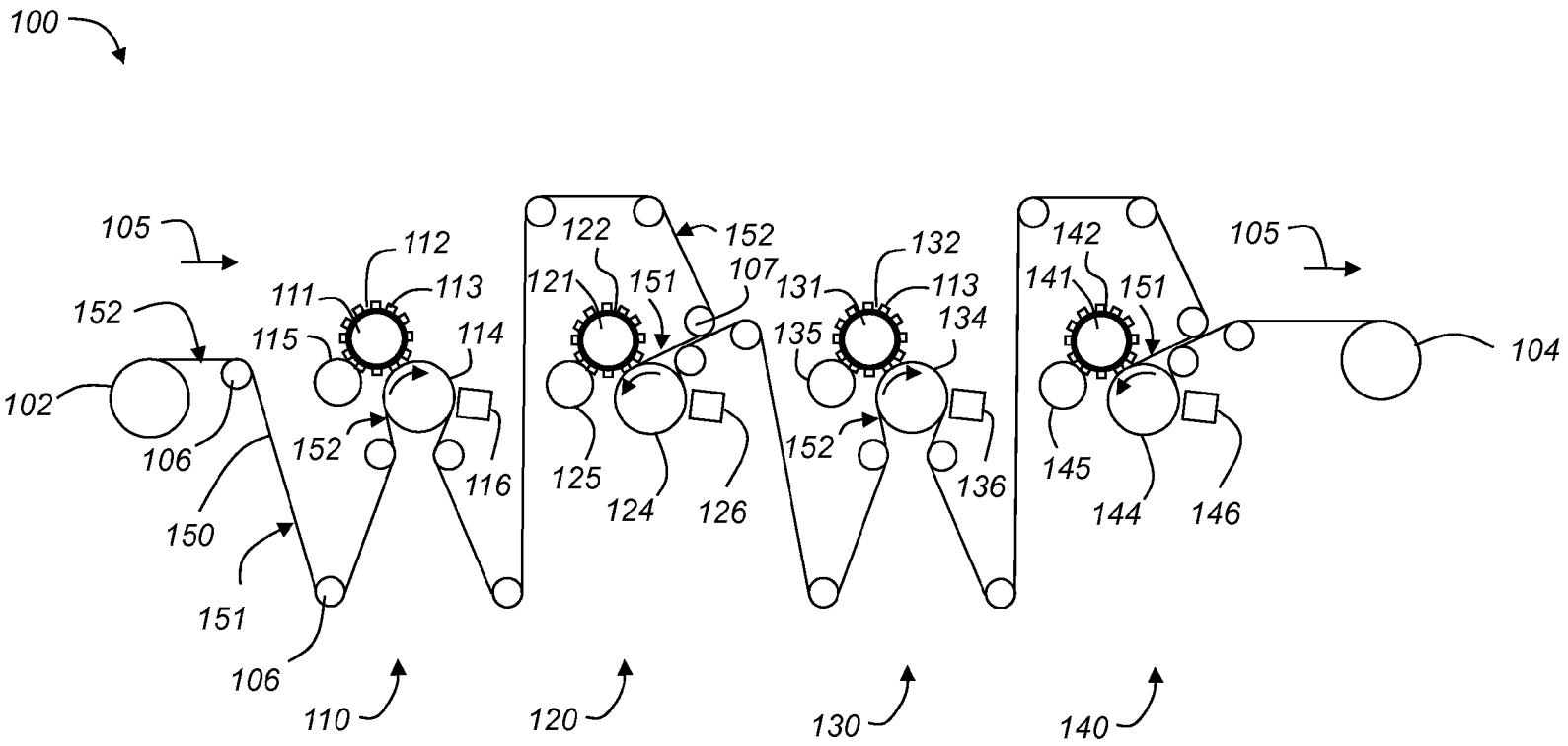
FIG. 1 is a schematic side view of a flexographic printing system for roll-to-roll printing on both sides of a substrate.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

References to upstream and downstream herein refer to direction of flow. Web media moves along a media path in a web advance direction from upstream to downstream. Similarly, fluids flow through a fluid line in a direction from upstream to downstream.

As described herein, the example embodiments of the present invention provide a roll-to-roll electroless plating system where air or gas are added to the plating solution in a manner that avoids bubbles becoming trapped beneath the web of media. The roll-to-roll electroless plating system is useful for metalizing printed features in sensor films incorporated into touch screens. However, many other applications are emerging for printing and electroless plating of functional devices that can be incorporated into other electronic, communications, industrial, household, packaging and product identification systems (such as RFID) in addition to touch screens. In addition, roll-to-roll electroless plating systems can be used to plate items for decorative purposes rather than electronic purposes and such applications are contemplated as well.

FIG. 1 is a schematic side view of a flexographic printing system 100 that can be used in embodiments of the invention for roll-to-roll printing of a catalytic ink on both sides of a substrate 150 for subsequent electroless plating. Substrate 150 is fed as a web from supply roll 102 to take-up roll 104 through flexographic printing system 100. Substrate 150 has a first side 151 and a second side 152.

The flexographic printing system 100 includes two print modules 120 and 140 that are configured to print on the first side 151 of substrate 150, as well as two print modules 110 and 130 that are configured to print on the second side 152 of substrate 150. The web of substrate 150 travels overall in roll-to-roll direction 105 (left to right in the example of FIG. 1). However, various rollers 106 and 107 are used to locally change the direction of the web of substrate as needed for adjusting web tension, providing a buffer, and reversing the substrate 150 for printing on an opposite side. In particular, note that in print module 120 roller 107 serves to reverse the local direction of the web of substrate 150 so that it is moving substantially in a right-to-left direction.

Each of the print modules 110, 120, 130, 140 includes some similar components including a respective plate cylinder 111, 121, 131, 141, on which is mounted a respective flexographic printing plate 112, 122, 132, 142, respectively. Each flexographic printing plate 112, 122, 132, 142 has raised features 113 defining an image pattern to be printed on the substrate 150. Each print module 110, 120, 130, 140 also includes a respective impression cylinder 114, 124, 134, 144 that is configured to force a side of the substrate 150 into contact with the corresponding flexographic printing plate 112, 122, 132, 142. Impression cylinders 124 and 144 of print modules 120 and 140 (for printing on first side 151 of substrate 150) rotate counter-clockwise in the view shown in FIG. 1, while impression cylinders 114 and 134 of print modules 110 and 130 (for printing on second side 152 of substrate 150) rotate clockwise in this view.

Each print module 110, 120, 130, 140 also includes a respective anilox roller 115, 125, 135, 145 for providing ink to the corresponding flexographic printing plate 112, 122, 132, 142. As is well known in the printing industry, an anilox roller is a hard cylinder, usually constructed of a steel or aluminum core, having an outer surface containing millions of very fine dimples, known as cells. Ink is provided to the anilox roller by a tray or chambered reservoir (not shown). In some embodiments, some or all of the print modules 110, 120, 130, 140 also include respective UV curing stations 116, 126, 136, 146 for curing the printed ink on substrate 150.

Figure 2:
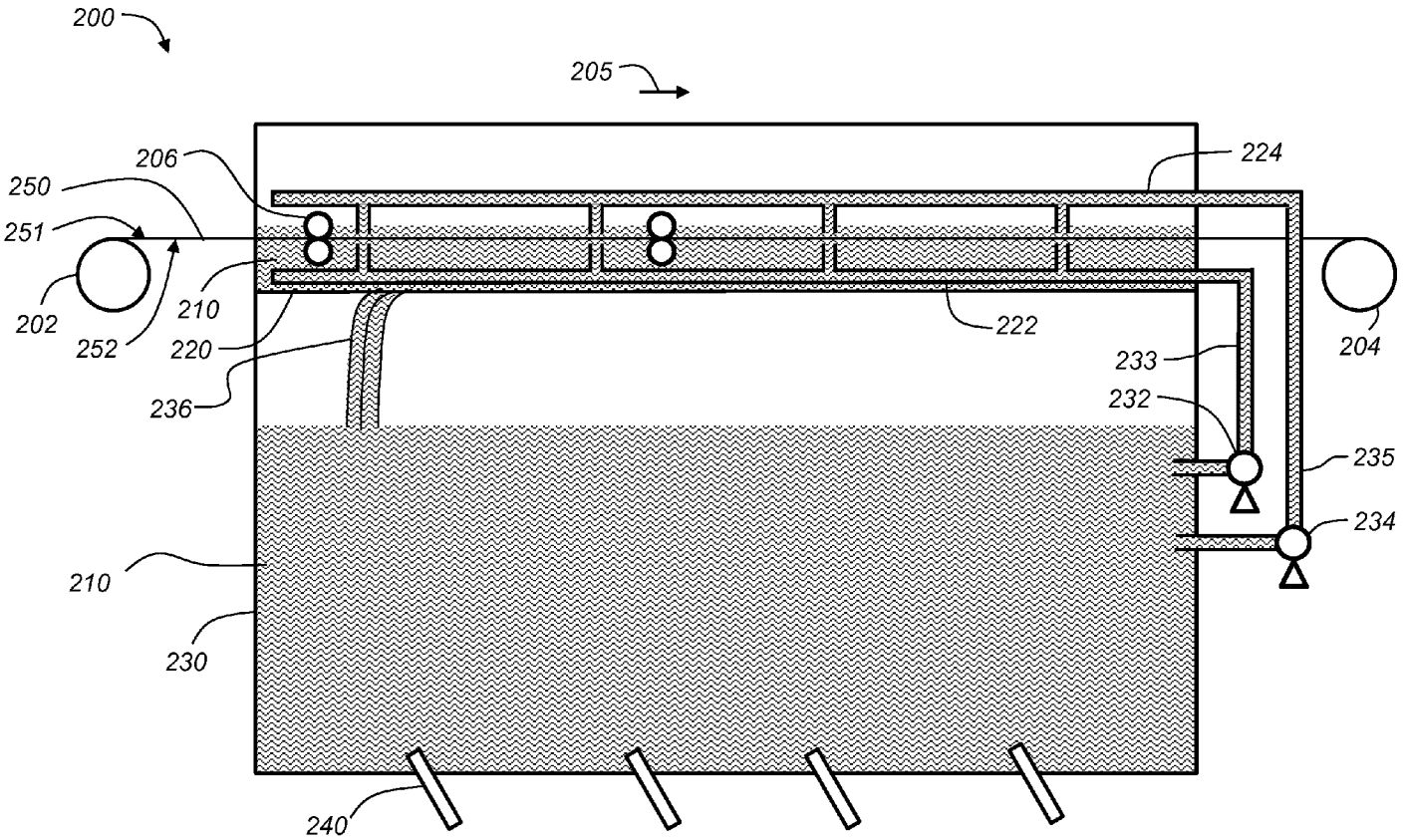
FIG. 2 (Prior Art)
FIG. 2 is a schematic side view of a prior art roll-to-roll electroless plating system.

FIG. 2 is a schematic side view of a prior art roll-to-roll electroless plating system 200, similar to a configuration available from Chemcut Corporation, for use with a plating solution 210. The roll-to-roll electroless plating system 200 performs well with plating solutions 210 that are formulated for optimized plating with relatively high dissolved oxygen content (e.g., greater than 3 parts per million). Substrate 250 is fed as a web of media from supply roll 202 to take-up roll 204. Drive rollers 206 advance the web in a web advance direction 205 from the supply roll 202 through a reservoir of the plating solution 210 to the take-up roll 204. In the configuration shown in FIG. 2, a sump 230 contains a large volume of the plating solution 210, and a pan 220 positioned above the sump contains a smaller volume of the plating solution 210.

As the substrate 250 is advanced through the plating solution 210 in the pan 220, a metallic plating substance such as copper, silver, nickel or palladium is electrolessly plated from the plating solution 210 onto predetermined locations on one or both of a first surface 251 and a second surface 252 of the substrate 250. As a result, the concentration of the metal in the plating solution 210 in the pan 220 decreases and the plating solution 210 needs to be refreshed. To refresh the plating solution 210, it is recirculated between the sump 230 and the pan 220. A lower lift pump 232 moves plating solution 210 from the sump 230 through a pipe 233 to a lower flood bar 222 for distribution into the pan 220 below the substrate 250. Likewise, an upper lift pump 234 moves plating solution 210 from the sump 230 through a pipe 235 to an upper flood bar 224 for distribution into the pan 220 above the substrate 250. Excess plating solution 210 waterfalls back into the sump 230 at freefall return 236. Occasionally the plating solution 210 is chemically analyzed, for example by titration, and fresh plating solution 210, or components of the plating solution 210, are added to the sump 230 as needed. Air inlet tubes 240 are provided to provide additional oxygen to the plating solution 210 in sump 230 as needed.

Although the prior art roll-to-roll electroless plating system 200 shown in FIG. 2 works well for plating solutions 210 that are designed to plate at relatively high levels of dissolved oxygen, for example greater than 3 parts per million, it has been found that it does not work well for plating solutions 210 that are designed to plate at a lower level of dissolved oxygen, for example between about 0.5 parts per million and about 2 parts per million. Not adding air through the air inlet tubes 240 is an obvious measure for reducing the dissolved oxygen content in the plating solution 210. However, in order to control the dissolved oxygen content at the desired low level, it is necessary to make significant modifications to the roll-to-roll electroless plating system 200.

Figure 3:
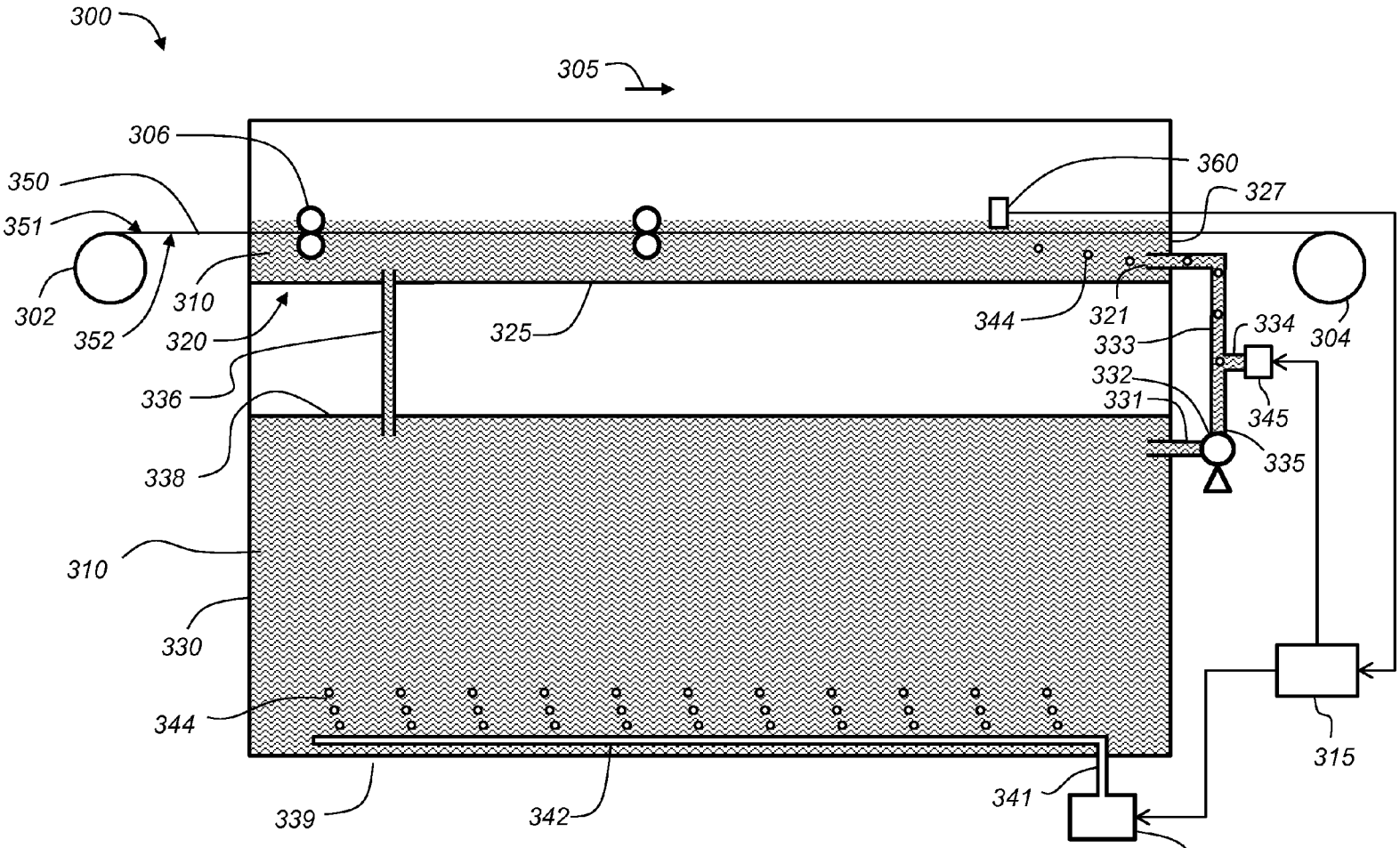
FIG. 3 is a schematic side view of a roll-to-roll electroless plating system.

FIG. 3 is a schematic side view of an improved roll-to-roll electroless plating system 300 described in commonly-assigned, co-pending U.S. patent application Ser. No. 14/455,196, entitled "Roll-to-roll electroless plating system with low dissolved oxygen content" by G. Wainwright et al., which is useful for plating solutions 310 having a low level of dissolved oxygen content. As in the prior art roll-to-roll electroless plating system 200, a substrate 350 is fed as a web of media from a supply roll 302 to a take-up roll 304. Drive rollers 306 advance the web of substrate 350 horizontally along a web advance direction 305 from the supply roll 302 through a reservoir of plating solution 310 to the take-up roll 304. A sump 330 contains a large volume of the plating solution 310 and a pan 320 positioned above the sump contains a smaller volume of the plating solution 310. The term "reservoir" can be used to refer to either the sump 330 or the pan 320.

As the substrate 350 is advanced through the plating solution 310 in pan 320, a metallic plating substance such as copper, silver, nickel or palladium is electrolessly plated from the plating solution 310 onto predetermined locations on one or both of a first surface 351 and a second surface 352 of the substrate 350. The predetermined locations can be provided, for example, by the prior printing of a catalytic ink.

A number of modifications were made relative to the prior art roll-to-roll electroless plating system 200 of FIG. 2 to control the amount of dissolved oxygen in the plating solution within a lower range of about 0.5 to about 2 parts per million. The modifications include measures to a) reduce the amount of turbulence in the plating solution 310 in portions of the roll-to-roll electroless plating system 300 that are exposed to air, b) reduce the exposure of the plating solution 310 to ambient air, c) displace dissolved oxygen from the plating solution 310, and d) sense the amount of dissolved oxygen in the plating solution 310.

Modifications for reducing turbulence in the roll-to-roll electroless plating system 300 of FIG. 3 relative to the prior art roll-to-roll electroless plating system 200 of FIG. 2 include replacing the freefall return 236 (FIG. 2) with a more controlled flow of the plating solution 310 through a drain pipe 336; eliminating the lower flood bar 222 and the upper flood bar 224 (FIG. 2); and removing the upper lift pump 234 and its associated plumbing. Instead, in roll-to-roll electroless plating system 300, there is only a single pan-replenishing pump 332 that moves plating solution 310 from the sump 330 to the pan 320 through a pipe 333 connected to an outlet 335 of the pan-replenishing pump 332. Plating solution 310 enters the pan-replenishing pump 332 from sump 330 via an inlet 331.

In addition to reducing splashing and other forms of turbulence, drain pipe 336 also reduces the exposure of plating solution 310 to ambient air. The top of drain pipe 336 is within the plating solution 310 in pan 320, and the bottom of drain pipe 336 is within the plating solution 310 in sump 330. Other measures for reducing the exposure of plating solution 310 to ambient air include providing a sump cover 338 and optionally providing a pan cover 328 (see FIG. 4).

Modifications also provide for the displacement of dissolved oxygen from the plating solution 310. This is done by injecting an inert gas into the plating solution 310 via a distribution system. As used herein, the term inert gas refers to a gas that does not take part in the chemical reactions necessary for electroless plating. Nitrogen is an example of such an inert gas. Another example of an inert gas would be argon. In various embodiments, the inert gas can also be injected into one or both of the sump 330 and pan 320. FIG. 3 shows inert gas being injected into the pan 320 from an inert gas source 345. In the illustrated embodiment, the inert gas from the inert gas source 345 is inserted into pipe 333 through tee 334 upstream of pan inlet 321, forming gas bubbles 344 which are carried into the pan 320.

FIG. 3 also shows gas bubbles 344 of inert gas being injected into the sump 330 from inert gas source 340. As the inert gas is dissolved in the plating solution 310, the amount of dissolved oxygen decreases. To facilitate dissolution of the inert gas, it is advantageous to inject the inert gas as micro-bubbles and to distribute the inert gas in such a way as to promote longer paths through the plating solution 310 before exiting. In the embodiment of FIG. 3, the gas bubbles 344 are injected through a plumbing assembly 342 located near a bottom 339 of sump 330 so that the injected gas bubbles 344 will rise through nearly the entire height of the plating solution 310. The inert gas enters the plumbing assembly 342 from the inert gas source 340 through an inert gas inlet 341.

Within the context of the present invention, micro-bubbles are defined as bubbles having a diameter between about one micron (one thousandth of a millimeter) and one millimeter. Since the ratio of surface area to volume of a sphere is inversely dependent upon diameter, micro-bubbles have a larger surface area to volume ratio than larger bubbles, thereby facilitating efficient dissolution into the plating solution 310. In addition, micro-bubbles tend to stay suspended longer in the plating solution 310 rather than rising and bursting rapidly.

It is also advantageous to control the amount of flow of inert gas into the plating solution 310 according to a measured amount of dissolved oxygen in the plating solution 310. An oxygen sensor 360 can be immersed into, or periodically dipped into (e.g., using motor 362), the plating solution 310 to measure the dissolved oxygen content. The data from the oxygen sensor 360 can be provided to a controller 315 to control the rate of flow of inert gas injected into plating solution 310 from inert gas source 340 or inert gas source 345, for example by controlling flow rate through a needle valve (not shown).

Figure 4:
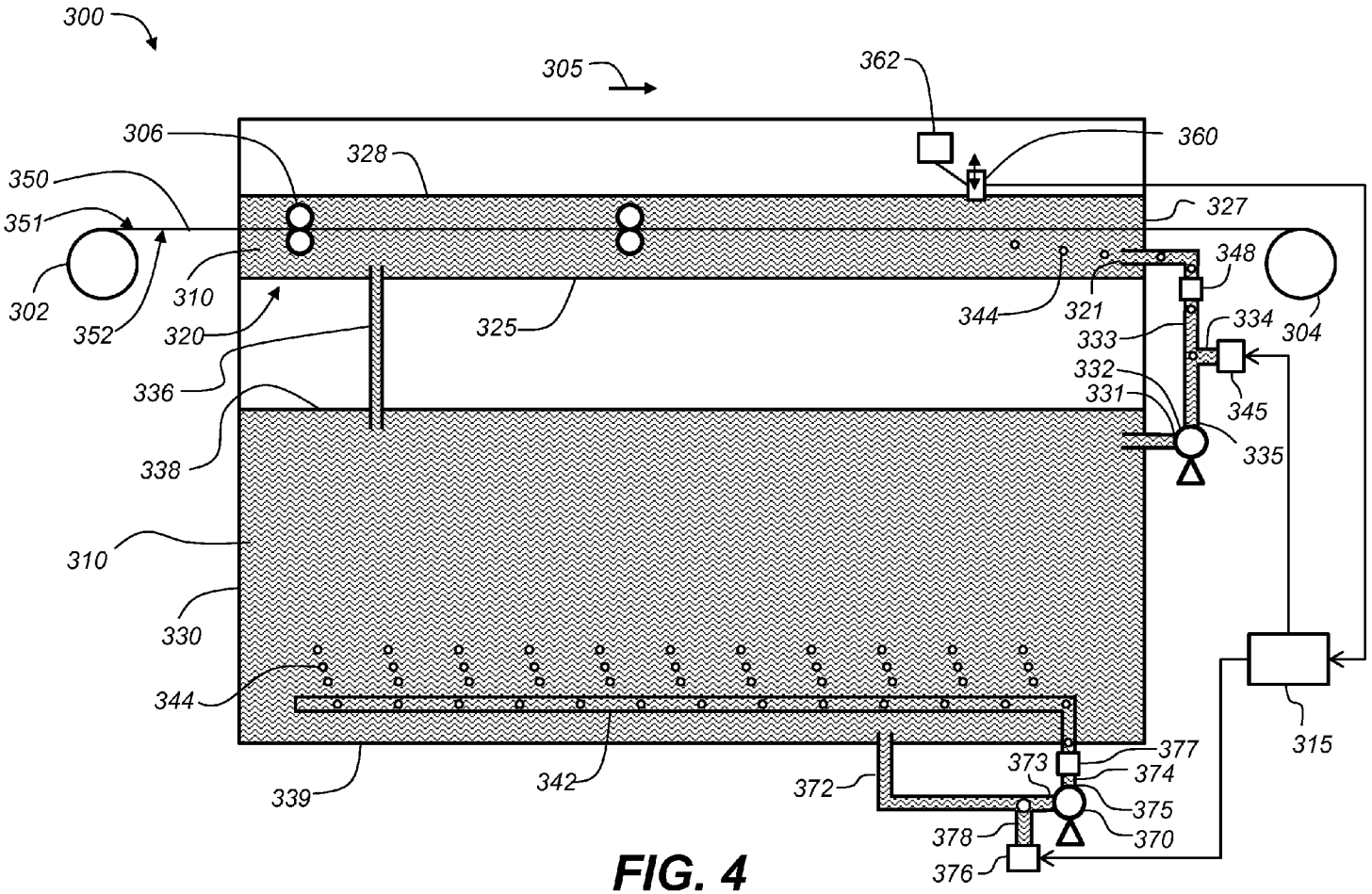
FIG. 4 is a schematic side view of a roll-to-roll electroless plating system.

FIG. 4 shows a schematic side view of another example of a roll-to-roll electroless plating system 300 described in commonly-assigned, co-pending U.S. patent application Ser. No. 14/455,196, entitled "Roll-to-roll electroless plating system with low dissolved oxygen content" by G. Wainwright et al., where micro-bubbles of inert gas are injected into the sump 330 by means of a recirculation system including a recirculation pump 370 having an inlet 373 and an outlet 375; an inlet line 372 for moving plating solution 310 from the sump 330 to the pump inlet 373; and an outlet line 374 for returning plating solution 310 from the pump outlet 375 to the sump 330. In the example shown in FIG. 4, inert gas is injected into the low pressure inlet 373 of the recirculation pump 370 from an inert gas source 376 connected to inlet 373 by tee 378. Mechanical action within recirculation pump 370 tends to break inert gas bubbles into micro-bubbles, which then flow together with plating solution 310 from the pump outlet 375 into the sump 330 through a plumbing assembly 342 located near bottom 339 of sump 330 providing the gas bubbles 344. Furthermore, a filter 377 can be disposed in the outlet line 374 for removing particulates so that they do not re-enter the sump 330. A second function of filter 377, which may have a pore size on the order of one micron, can optionally be used to break up bubbles of inert gas into micro-bubbles. Thus, inert gas is injected into the plating solution 310 outside the sump 330 to provide an inert-gas-rich plating solution 310, and the inert-gas-rich plating solution 310 is delivered into the sump 330.

An advantage of injecting inert gas on the low pressure inlet side of a pump is that the inert gas source 376 can be a low pressure source for improved flow control. However, a potential disadvantage of injecting inert gas into a pump inlet is cavitation damage within the pump. FIG. 4 also shows inert gas flowing from inert gas source 345 through a tee 334 into pipe 333 downstream of the outlet 335 of pan-replenishing pump 332 and upstream of pan inlet 321. Thus, inert gas is injected into the plating solution 310 outside the pan 320 to provide an inert-gas-rich plating solution 310, and the inert-gas-rich plating solution 310 is delivered into the pan 320 through the pipe 333 at pan inlet 321. A filter 348 can be used for further reducing the size of gas bubbles 344.

In FIGS. 3 and 4 pipe 333 delivers plating solution 310 to pan inlet 321 positioned near an end 327 of pan 320 and proximate to a bottom 325 of the pan 320. Herein, "proximate to a bottom of the pan" is understood to mean "below the web of substrate 350".

Figure 5:
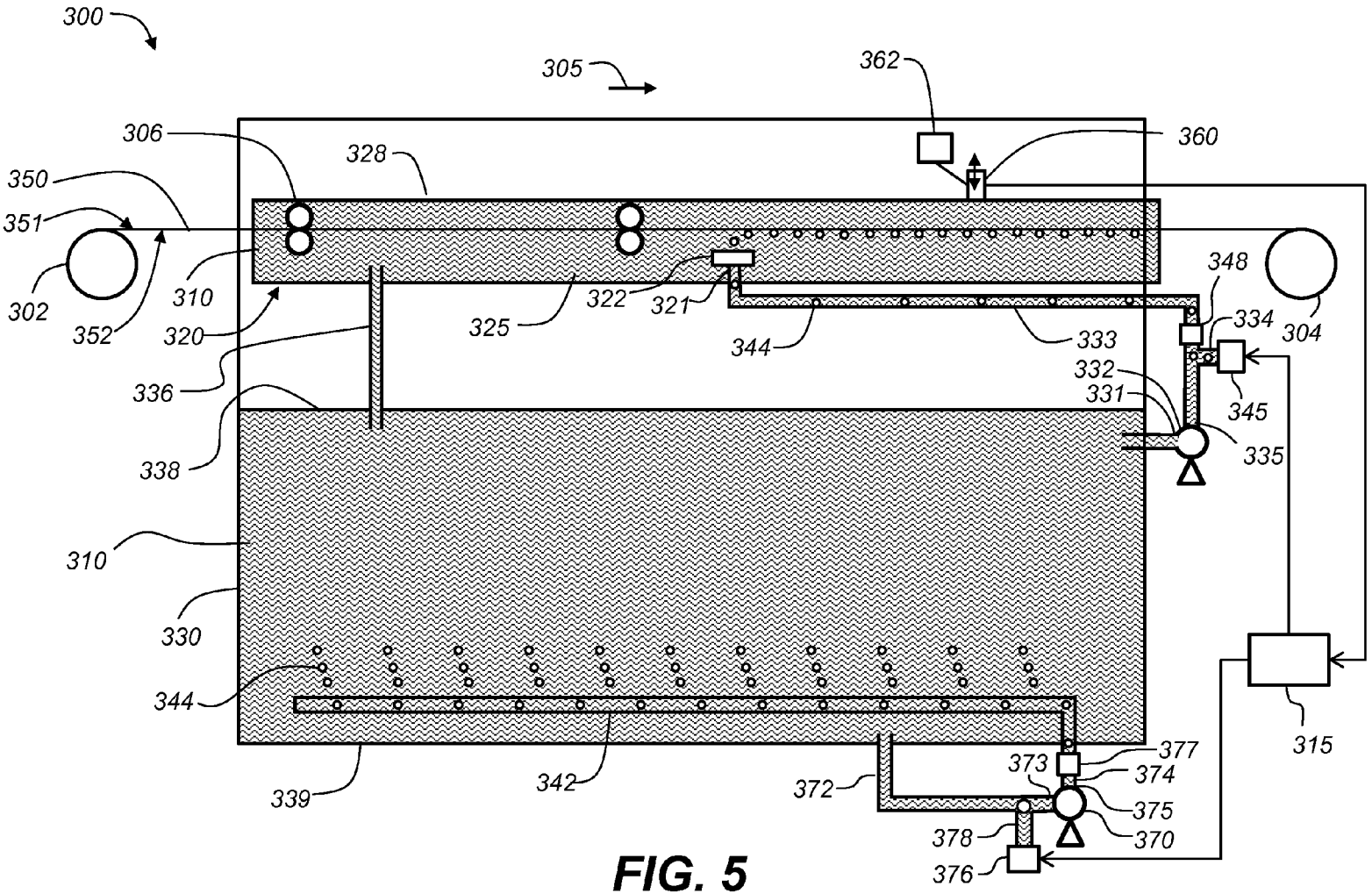
FIG. 5 is a schematic side view of a roll-to-roll electroless plating system including a pan inlet in the bottom of the pan.

FIG. 5 shows a configuration for a roll-to-roll electroless plating system 300 which is similar to that shown in FIG. 4 except that the pipe 333 delivers plating solution 310 to a pan inlet 321 centrally positioned in pan 320 in proximity to the bottom 325 of pan 320. Furthermore, the pan inlet 321 is connected to a flood bar 322.

Although in the examples described above, inert gas is added to the plating solution 310 re-entering the pan 320 at pan inlet 321, in some embodiments, air or oxygen can be added to the plating solution 310 re-entering the pan 320 at pan inlet 321 as needed for adjusting the dissolved oxygen content in the plating solution 310 in the pan 320.

Figure 6:
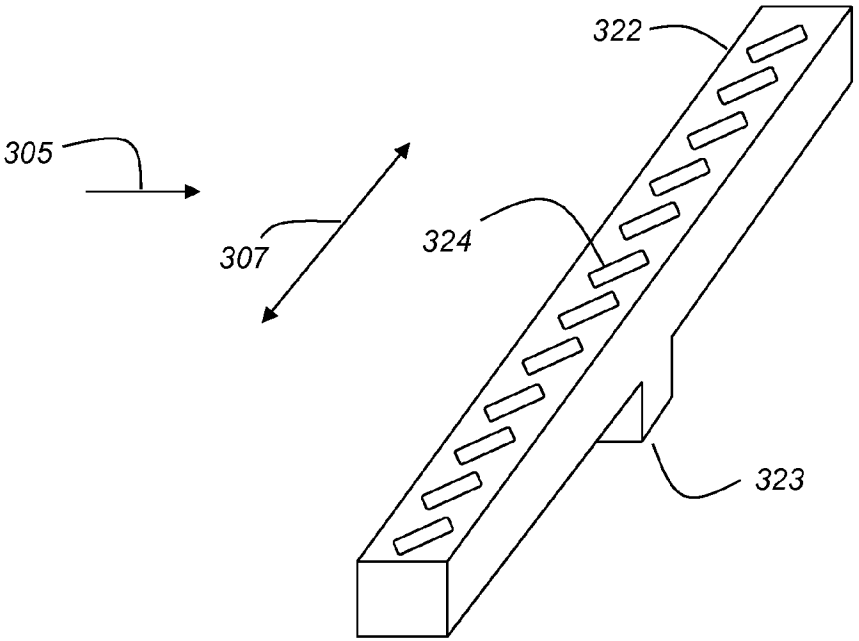
FIG. 6 (Prior Art)
FIG. 6 is a perspective of a prior art flood bar.

FIG. 6 is a perspective of a prior art flood bar 322 extending along a cross-track direction 307 that is perpendicular to the web advance direction 305. Inlet 323 of the flood bar 322 is fluidically connected to pan inlet 321 (FIG. 5) below the web of substrate 350. Conventional flood bar 322 includes an array of distribution orifices 324 for mixing the incoming plating solution 310 (FIG. 5) with the plating solution 310 already in the pan 320 (FIG. 5). For conventional roll-to-roll plating systems 200, such as the one shown in FIG. 2, where gas is not added to the plating solution 310 in pipe 233 just upstream of the pan inlet, a conventional flood bar 322 can be used and typically functions satisfactorily without causing problems. However, in a roll-to-roll electroless plating system 300, such as the one shown in FIG. 5, where the plating solution 310 contains gas bubbles 344 of gas as it enters the pan 320 below the horizontal web of substrate 350, the gas bubbles 344 will be released through distribution orifices 324, rise due to buoyancy, and be trapped beneath the web of substrate 350. This can have the undesirable effect of causing non-uniform plating on the second surface 352 of the substrate 350.

Figure 7:
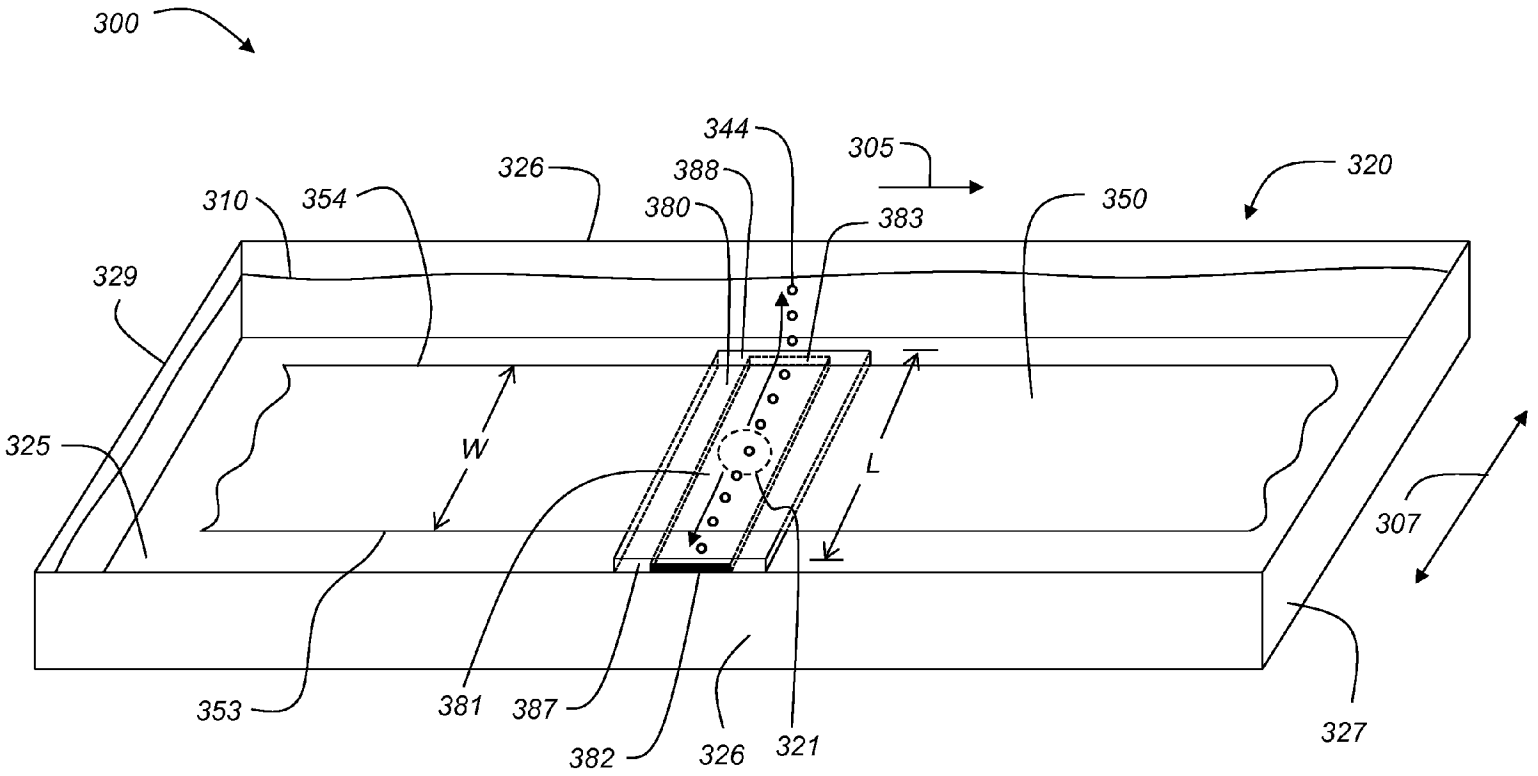
FIG. 7 is a perspective of a portion of a roll-to-roll electroless plating system having a spreader duct according to an embodiment of the invention.

FIG. 7 is a perspective of a portion of a roll-to-roll electroless plating system 300 according to an embodiment of the invention. Relative to the roll-to-roll electroless plating system 300 shown in FIG. 5, the flood bar 322 has been replaced with a spreader duct 380 extending substantially along cross-track direction 307. Spreader duct 380 includes a channel 381 that is in fluidic communication with pan inlet 321, and has one or more outlets 382, 383 located beyond the edges 353, 354 of the web of substrate 350. In the example shown in FIG. 7, web of substrate 350 has a first edge 353 and a second edge 354 that is separated from the first edge 353 by a width W along the cross-track direction 307. Outlet 382 is located beyond the first edge 353 of the web of substrate 350, and outlet 383 is located beyond the second edge 354 of the web of substrate 350. In other words, a vertical projections from outlets 382, 383 do not intersect the web of substrate 350. In this way, rather than directing the incoming plating solution 310 into pan 320 such that gas bubbles 344 are trapped beneath the web of substrate 350, gas bubbles 344 are allowed to float freely to the surface of the plating solution 310 near the sides 326 of the pan 320.

In the example shown in FIG. 7 where the pan inlet 321 is in the bottom 325 of pan 320, spreader duct 380 can simply include a rectangular body with a wide groove serving as the channel 381. The spreader duct 380 is positioned in proximity to the bottom 325 of pan 320 with channel 381 sitting over the pan inlet 321. If, as in the example of FIG. 7, the channel 381 includes a first end 387 and a second end 388 that is displaced from the first end 387 by a distance L that is greater than the width W between the first edge 353 and the second edge 354 of the web of substrate 350, outlets 382, 383 at both ends of channel 381 will be beyond the edges of the web of substrate 350. In this way plating solution 310 can be directed from pan inlet 321 toward both sides 326 of pan 320 in along cross-track direction 307 and release the gas bubbles 344 beyond the edges of the web of substrate 350 where they can rise freely to the surface of the plating solution 310 without being trapped beneath the substrate 350. Furthermore, the flow of plating solution 310 toward sides 326 helps to mix the replenished plating solution 310 in non-turbulent fashion in the pan 320. When the flow of plating solution 310 hits sides 326, it is redirected into other portions of the pan 320.

Figure 8C:
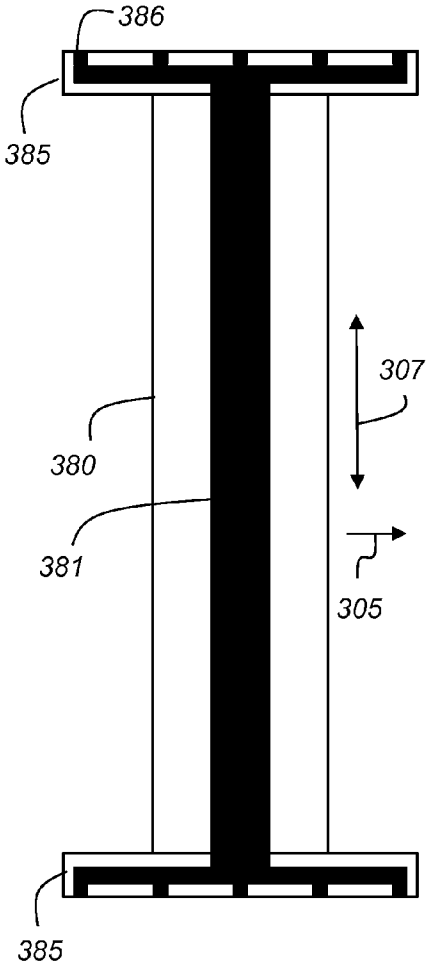
FIG. 8C is a bottom view of a spreader duct with a channel fluidically connected to manifolds according to an embodiment of the invention.
Figure 8B:
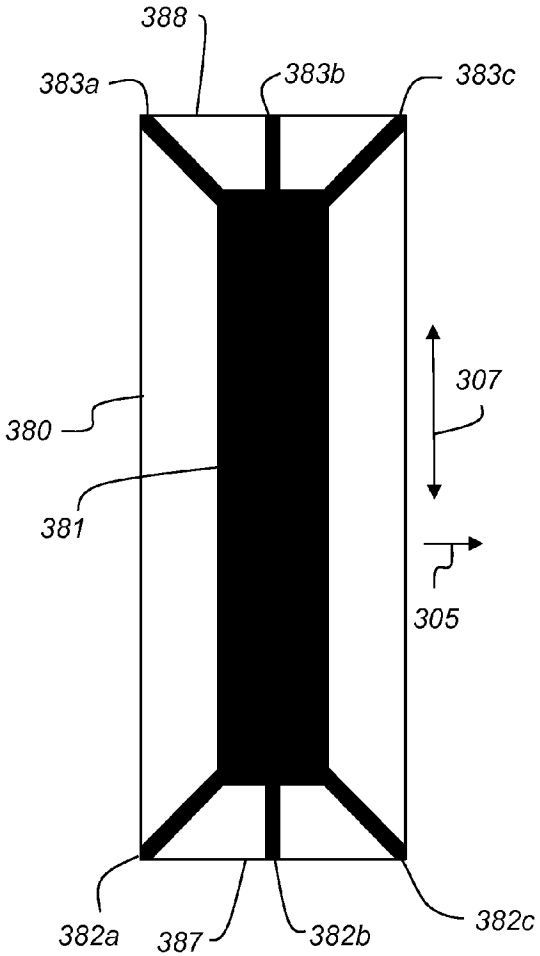
FIG. 8B is a bottom view of a spreader duct with a channel and outlet geometry according to an exemplary embodiment of the invention.
Figure 8A:
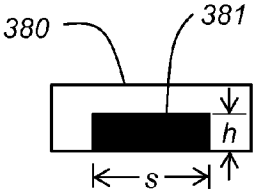
FIG. 8A is a cross-sectional view of a spreader duct according to an embodiment of the invention.

FIG. 8A illustrates a cross-sectional view of the spreader duct 380 from FIG. 7 in which the height h and width s of channel 381 are shown. In some embodiments the height h and width s of the channel 381 are constant throughout the length L (FIG. 7) of the channel 381. In other embodiments, in order to optimize the flow of plating solution 310, the channel 381 can have a nonuniform cross-section with varying width s or height h, or a non-rectangular cross-section.

In still other embodiments, the channel 381 can have a variety of different outlet arrangements. For example, FIG. 8B shows a bottom view of a spreader duct 380 having a plurality of outlets 382*a*, 382*b*, 382*c* distributed across the first end 387, and a second plurality of outlets 383*a*, 383*b*, 383*c* distributed across the second end 388. In the illustrated embodiment, some of the outlets 382*a*, 382*c*, 383*a*, 383*c* are not directed either parallel to cross-track direction 307 nor parallel to web advance direction 305. In this case, if the spreader duct 380 of FIG. 8B is used in the configuration of FIG. 7, the outermost outlets 382*a* and 383*a* that are closest to end 329 of pan 320 are oriented somewhat toward end 329, and the outermost outlets 382*c* and 383*c* that are closest to end 327 of pan 320 are oriented somewhat toward end 327. This configuration serves to direct the flow of replenished plating solution 310 to other portions of pan 320. Innermost outlets 382*b* and 383*b* are oriented parallel to cross-track direction 307 to direct flow of replenished plating solution 310 directly toward the opposite sides 326 of pan 320.

In other embodiments, as illustrated in the bottom view of spreader duct 380 shown in FIG. 8C, the channel 381 can be connected to a manifold 385 at one or both ends, where the manifold 385 extends for a greater distance along the web advance direction 305 than the spreader duct 380. In the illustrated example, the manifold 385 has a plurality of manifold outlets 386 distributed along the web advance direction 305, all being located beyond the first and second edges 353 and 354 of the web of substrate 350 (FIG. 7).

In the example shown in FIG. 7, spreader duct 380 has no outlets disposed below the web of substrate 350. In other embodiments (not shown), the roof of channel 381 can include a plurality of small perforations that allow plating solution to pass through, but not gas bubbles 344 (in an analogous manner to that described for the immersion plating tank disclosed in U.S. Pat. No. 5,284,520 to Tanaka entitled "Electroless plating device," which is incorporated herein by reference).

In the examples described above relative to FIGS. 5, 7 and 8A-8C, the channel 381 of the spreader duct 380 is in fluid communication with a pan inlet 321 positioned in the bottom 325 of the pan 320. For configurations as in FIGS. 3 and 4 where the pan inlet 321 is positioned in an end 327 of the pan 320, spreader duct 380 can have the form of a pipe (not shown) connected to pan inlet 321 and extending along cross-track direction 307 (FIG. 7) to one or more outlets (not shown) that are beyond the first edge 353 or second edges 354 of web of substrate 350.

Figure 9:
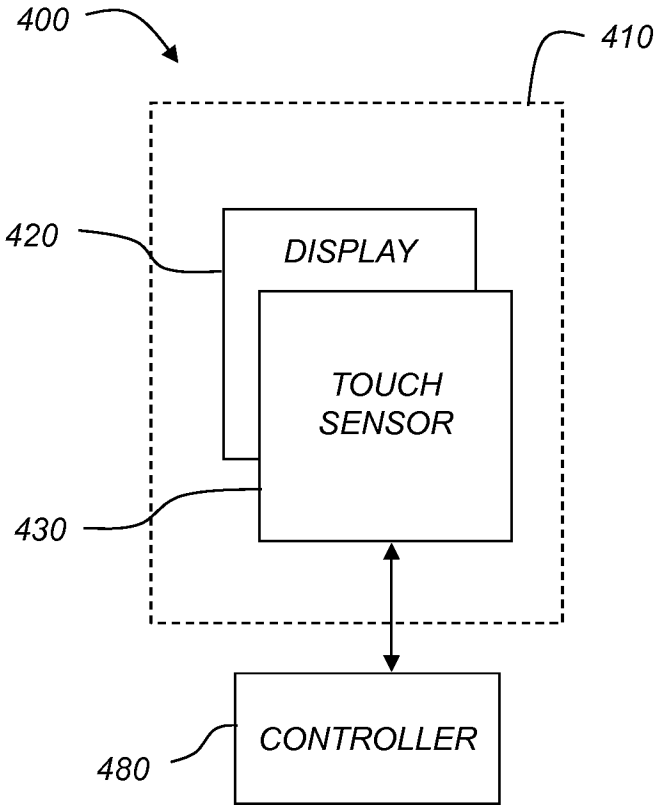
FIG. 9 is a high-level system diagram for an apparatus having a touch screen with a touch sensor that can be printed using embodiments of the invention.

FIG. 9 shows a high-level system diagram for an apparatus 400 having a touch screen 410 including a display device 420 and a touch sensor 430 that overlays at least a portion of a viewable area of display device 420. Touch sensor 430 senses touch and conveys electrical signals (related to capacitance values for example) corresponding to the sensed touch to a controller 480. Touch sensor 430 is an example of an article that can be printed on one or both sides by the flexographic printing system 100 and plated using an embodiment of roll-to-roll electroless plating system 300 having a spreader duct 380 as described above.

Figure 10:
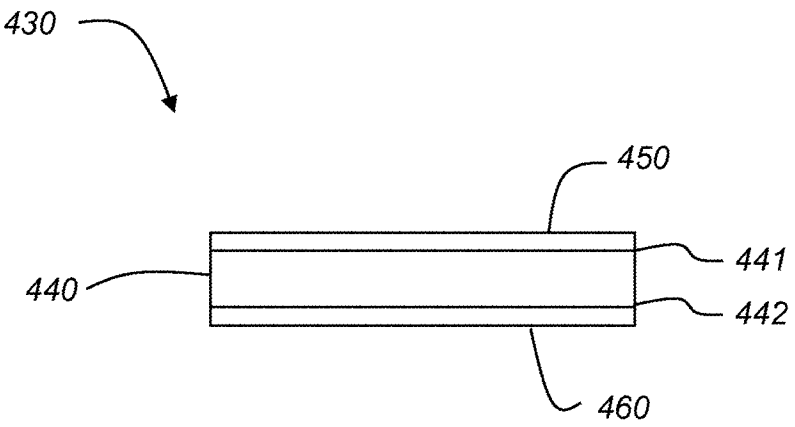
FIG. 10 is a side view of the touch sensor of FIG. 9.

FIG. 10 shows a schematic side view of a touch sensor 430. Transparent substrate 440, for example polyethylene terephthalate, has a first conductive pattern 450 printed and plated on a first side 441, and a second conductive pattern 460 printed and plated on a second side 442. The length and width of the transparent substrate 440, which is cut from the take-up roll 104 (FIG. 1), is not larger than the flexographic printing plates 112, 122, 132, 142 of flexographic printing system 100 (FIG. 1), but it could be smaller than the flexographic printing plates 112, 122, 132, 142.

Figure 11:
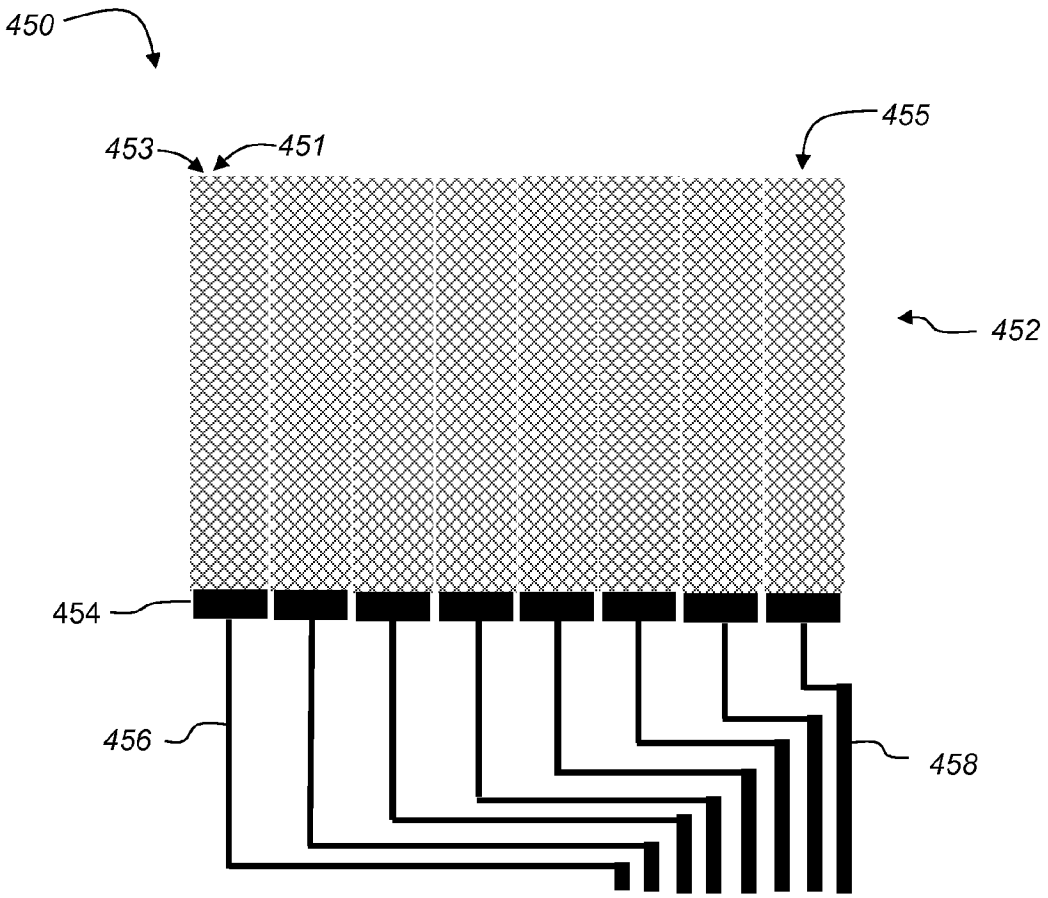
FIG. 11 is a top view of a conductive pattern printed on a first side of the touch sensor of FIG. 10.

FIG. 11 shows an example of a conductive pattern 450 that can be printed on first side 441 (FIG. 10) of substrate 440 (FIG. 10) using one or more print modules such as print modules 120 and 140 of flexographic printing system (FIG. 1), followed by plating using an embodiment of roll-to-roll electroless plating system 300 having a spreader duct 380 as described above. Conductive pattern 450 includes a grid 452 including grid columns 455 of intersecting fine lines 451 and 453 that are connected to an array of channel pads 454. Interconnect lines 456 connect the channel pads 454 to the connector pads 458 that are connected to controller 480 (FIG. 9). Conductive pattern 450 can be printed by a single print module 120 in some embodiments. However, because the optimal print conditions for fine lines 451 and 453 (e.g., having line widths on the order of 4 to 8 microns) are typically different than for printing the wider channel pads 454, connector pads 458 and interconnect lines 456, it can be advantageous to use one print module 120 for printing the fine lines 451 and 453 and a second print module 140 for printing the wider features. Furthermore, for clean intersections of fine lines 451 and 453, it can be further advantageous to print and cure one set of fine lines 451 using one print module 120, and to print and cure the second set of fine lines 453 using a second print module 140, and to print the wider features using a third print module (not shown in FIG. 1) configured similarly to print modules 120 and 140.

Figure 12:
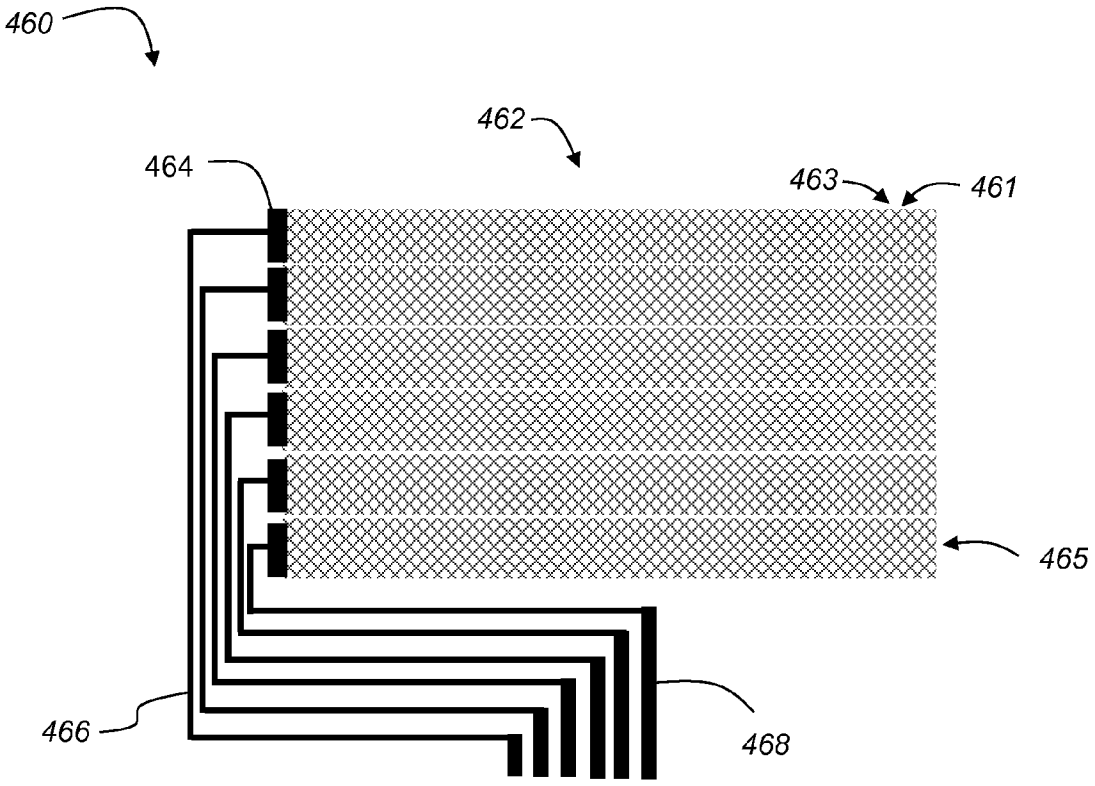
FIG. 12 is a top view of a conductive pattern printed on a second side of the touch sensor of FIG. 10.

FIG. 12 shows an example of a conductive pattern 460 that can be printed on second side 442 (FIG. 10) of substrate 440 (FIG. 10) using one or more print modules such as print modules 110 and 130 of flexographic printing system (FIG. 1), followed by plating using an embodiment of roll-to-roll electroless plating system 300 having a spreader duct 380 as described above. Conductive pattern 460 includes a grid 462 including grid rows 465 of intersecting fine lines 461 and 463 that are connected to an array of channel pads 464. Interconnect lines 466 connect the channel pads 464 to the connector pads 468 that are connected to controller 480 (FIG. 9). In some embodiments, conductive pattern 460 can be printed by a single print module 110. However, because the optimal print conditions for fine lines 461 and 463 (e.g., having line widths on the order of 4 to 8 microns) are typically different than for the wider channel pads 464, connector pads 468 and interconnect lines 466, it can be advantageous to use one print module 110 for printing the fine lines 461 and 463 and a second print module 130 for printing the wider features. Furthermore, for clean intersections of fine lines 461 and 463, it can be further advantageous to print and cure one set of fine lines 461 using one print module 110, and to print and cure the second set of fine lines 463 using a second print module 130, and to print the wider features using a third print module (not shown in FIG. 1) configured similarly to print modules 110 and 130.

Alternatively, in some embodiments conductive pattern 450 can be printed using one or more print modules configured like print modules 110 and 130, and conductive pattern 460 can be printed using one or more print modules configured like print modules 120 and 140 of FIG. 1 followed by plating using an embodiment of roll-to-roll electroless plating system 300 having a spreader duct 380 as described above.

With reference to FIGS. 9-12, in operation of touch screen 410, controller 480 can sequentially electrically drive grid columns 455 via connector pads 458 and can sequentially sense electrical signals on grid rows 465 via connector pads 468. In other embodiments, the driving and sensing roles of the grid columns 455 and the grid rows 465 can be reversed.

The invention has been described in detail with particular reference to certain preferred embodiments thereof, but it will be understood that variations and modifications can be effected within the spirit and scope of the invention.

PARTS LIST

100 flexographic printing system
102 supply roll
104 take-up roll
105 roll-to-roll direction
106 roller
107 roller
110 print module
111 plate cylinder
112 flexographic printing plate
113 raised features
114 impression cylinder
115 anilox roller
116 UV curing station
120 print module
121 plate cylinder
122 flexographic printing plate
124 impression cylinder
125 anilox roller
126 UV curing station
130 print module
131 plate cylinder
132 flexographic printing plate
134 impression cylinder
135 anilox roller
136 UV curing station

140 print module
141 plate cylinder
142 flexographic printing plate
144 impression cylinder
145 anilox roller
146 UV curing station
150 substrate
151 first side
152 second side
200 roll-to-roll electroless plating system
202 supply roll
204 take-up roll
205 web advance direction
206 drive roller
210 plating solution
220 pan
222 lower flood bar
224 upper flood bar
230 sump
232 lower lift pump
233 pipe
234 upper lift pump
235 pipe
236 freefall return
240 air inlet tube
250 substrate
251 first surface
252 second surface
300 roll-to-roll electroless plating system
302 supply roll
304 take-up roll
305 web advance direction
306 drive roller
307 cross-track direction
310 plating solution
315 controller
320 pan
321 pan inlet
322 flood bar
323 inlet
324 distribution orifices
325 bottom
326 side
327 end
328 pan cover
329 end
330 sump
331 inlet
332 pan-replenishing pump
333 pipe
334 tee
335 outlet
336 drain pipe
338 sump cover
339 bottom
340 inert gas source
341 inert gas inlet
342 plumbing assembly
344 gas bubbles
345 inert gas source
348 filter
350 substrate
351 first surface
352 second surface
353 edge
354 edge
360 oxygen sensor
362 motor
370 recirculation pump
372 inlet line
373 inlet
374 outlet line
375 outlet
376 inert gas source
377 filter
378 tee
379 plumbing assembly
380 spreader duct
381 channel
382 outlet
**382*a*** outlet
**382*b*** outlet
**382*c*** outlet
383 outlet
**383*a*** outlet
**383*b*** outlet
**383*c*** outlet
385 manifold
386 manifold outlet
387 end
388 end
400 apparatus
410 touch screen
420 display device
430 touch sensor
440 transparent substrate
441 first side
442 second side
450 conductive pattern
451 fine lines
452 grid
453 fine lines
454 channel pads
455 grid column
456 interconnect lines
458 connector pads
460 conductive pattern
461 fine lines
462 grid
463 fine lines
464 channel pads
465 grid row
466 interconnect lines
468 connector pads
480 controller
h height
L distance
s width
W width

The invention claimed is:

1. A roll-to-roll electroless plating system, comprising:

a sump containing a first volume of a plating solution;

a pan containing a second volume of the plating solution, the second volume being less than the first volume;

a web advance system for advancing a web of substrate from an input roll though the plating solution in the pan along a web advance direction and to a take-up-roll, the web of substrate including a first edge and a second edge that is separated from the first edge along a cross-track direction perpendicular to the web advance direction, wherein a plating substance in the plating solution is plated onto predetermined locations on a surface of the web of substrate as it is advanced through the plating solution in the pan;

a pan-replenishing pump for moving plating solution from the sump to an inlet of the pan through a pipe connected to an outlet of the pan-replenishing pump, the inlet of the pan being located in proximity to a bottom of the pan below the web of substrate; and a spreader duct including a channel that is in fluidic communication with the inlet of the pan, wherein the channel is positioned below the web of substrate and includes at least one outlet disposed beyond the first edge or the second edge of the web of substrate, and wherein the channel has no outlets disposed immediately below the web of substrate.

2. The roll-to-roll electroless plating system of claim 1, further including an inert gas source that is configured to inject bubbles of a gas into the plating solution upstream of the inlet of the pan.

3. The roll-to-roll electroless plating system of claim 2 wherein the gas is air, oxygen or an inert gas.

4. The roll-to-roll electroless plating system of claim 3, wherein the inert gas is nitrogen.

5. The roll-to-roll electroless plating system of claim 1, wherein the plating substance is copper.

6. The roll-to-roll electroless plating system of claim 1, wherein the channel includes a first end and a second end that is displaced from the first end by a distance that is greater than a substrate width between the first edge and the second edge of the web of substrate.

7. The roll-to-roll electroless plating system of claim 1, wherein the web of substrate is oriented horizontally within the pan of plating solution.

8. The roll-to-roll electroless plating system of claim 1 further including an oxygen sensor.

9. The roll-to-roll electroless plating system of claim 8 further including a controller, wherein the controller is configured to receive data from the oxygen sensor and to control a rate of injection of a gas into the plating solution in response to the data received from the oxygen sensor.

10. The roll-to-roll electroless plating system of claim 1, wherein a cross-section of the channel of the spreader duct is non-uniform.

11. The roll-to-roll electroless plating system of claim 1, wherein one or more outlets of the channel are oriented in a direction which is not parallel to the web advance direction and not parallel to the cross-track direction.

12. The roll-to-roll electroless plating system of claim 1 further including a manifold, wherein the manifold is fluidically connected to the channel of the spreader duct and has a plurality of manifold outlets distributed along the web advance direction beyond the first edge or the second edge of the web of substrate.

13. The roll-to-roll electroless plating system of claim 1, wherein the predetermined locations include features printed onto the web of substrate with ink including a catalyst for plating.

* * * * *